US012760486B2

(12) United States Patent
Lin et al.

(10) Patent No.: US 12,760,486 B2
(45) Date of Patent: Oct. 13, 2026

(54) LARGE-SCALE OFFSHORE HYDRAULIC PILING HAMMER

(71) Applicant: Zhejiang Yongan Construction Machinery Co., Ltd., Wenzhou (CN)

(72) Inventors: Deng Lin, Wenzhou (CN); Haiqiang Wang, Wenzhou (CN); Jian Wei, Wenzhou (CN); Yifeng Lu, Wenzhou (CN); Wen Lin, Wenzhou (CN); Jinduo Wang, Wenzhou (CN); Jian Zhang, Wenzhou (CN)

(73) Assignee: Zhejiang Yongan Construction Machinery Co., Ltd., Wenzhou (CN)

( * ) Notice: Subject to any disclaimer, the term of this patent is extended or adjusted under 35 U.S.C. 154(b) by 0 days.

(21) Appl. No.: 19/216,368

(22) Filed: May 22, 2025

(65) Prior Publication Data

US 2025/0361691 A1 Nov. 27, 2025

(30) Foreign Application Priority Data

May 22, 2024 (CN) ..... 202410638853.1

(51) Int. Cl.
*E02D 7/10* (2006.01)
*E02D 7/16* (2006.01)

(52) U.S. Cl.
CPC *E02D 7/10* (2013.01); *E02D 7/16* (2013.01)

(58) Field of Classification Search
CPC .... E02D 7/16; E02D 7/10; E02D 7/28; E02D 7/30
See application file for complete search history.

(56) References Cited

U.S. PATENT DOCUMENTS 4,367,800 A * 1/1983 Arentsen ..... E02D 7/10 173/127
2008/0292407 A1* 11/2008 Jonker ..... E02D 7/10 405/228
2014/0314495 A1* 10/2014 Arentsen ..... E02D 7/10 173/206
2019/0226173 A1* 7/2019 Desborough ..... E02D 7/06
2022/0349144 A1* 11/2022 Winkes ..... E02D 7/14

FOREIGN PATENT DOCUMENTS

CN 113136862 A * 7/2021 ..... E02D 7/10

OTHER PUBLICATIONS

Translation of CN 113136862 A (Year: 2021).*

* cited by examiner

*Primary Examiner* — Thomas M Wittenschlaeger
(74) *Attorney, Agent, or Firm* — Suiter Swantz IP

(57) ABSTRACT

Provided is a large-scale offshore hydraulic piling hammer including: a hammer housing and a ram in the hammer housing; at least one hydraulic assembly capable of driving the ram to move axially along hammer housing to strike an anvil and disposed between hammer housing and ram; a pile sleeve including an upper pile sleeve and a lower pile sleeve; and an anvil disposed in upper pile sleeve. An increased-diameter ring is disposed at the bottom of anvil in the upper pile sleeve and has a first mounting groove for mounting anvil. A first mounting cavity is formed between an inner cavity of increased-diameter ring and anvil. A second mounting cavity is formed between a bottom surface of increased-diameter ring and an inner wall of lower pile sleeve. The second mounting cavity has a diameter greater than that of the first mounting cavity.

19 Claims, 12 Drawing Sheets

LARGE-SCALE OFFSHORE HYDRAULIC PILING HAMMER

CROSS-REFERENCE TO RELATED APPLICATION

This application claims the priority of Chinese Patent Application No. 202410638853.1, filed with the Chinese Patent National Intellectual Property Administration on May 22, 2024, which is incorporated herein by reference in its entirety as part of the present application.

TECHNICAL FIELD

The present disclosure relates to the technical field of construction machinery, in particular to a large-scale offshore hydraulic piling hammer.

BACKGROUND

Piling hammers are indispensable equipment for civil engineering works, and utilize impact force to drive piles into the ground to complete the installation of prefabricated piles, in the form such as drop hammers, diesel hammers, steam hammers, hydraulic hammers, vibratory hammers, and static hammers. These piles may be used for establishing foundations of buildings or to carry out works such as geological improvement. The technology of piling hammers has advanced with economic development, and current piling hammers are adaptable to a variety of complex construction environments and requirements.

The applicant has applied for a hydraulic piling hammer with Publication No. CN 107724390 B, which includes a hammer body and a ram capable of moving axially along the hammer body. The hammer body has a space for holding and moving of the ram. The hammer body is a columnar frame. The hammer body is provided with a stamping head fixedly connected to the hammer body and having a conical cross-section. Multiple openings that can be climbed for an operator are formed axially on an outer end face of the frame. A wear rib removably connected to the frame is disposed on an inner wall of the frame. A protector capable of sensing the ram and sending a signal to an external hydraulic system to control its start and stop is disposed in the middle of the frame. Provided is a hydraulic piling hammer with wear-resistant ram and hammer body, which has less impact resistance and is easy to overhaul.

Although the wear of the ram and the hammer body is avoided in the above document, some of piling hammers may be provided with shackles at the top of a hammer housing for connecting a pile body and transferring an impact force, and the shackles at the top of the hammer housing will vibrate by mechanical collision with the hammer body during construction, which will result in pits or wear of the hammer body, and even breaks at the joint between the shackles and the hammer housing, thus leading to safety hazard.

In addition, with respect to the structural form of the nuts and screws of the existing conventional shackles, on the condition that the piling hammer vibrates frequently and violently, the nuts sleeving over the screws are prone to moving, and even falling off from the screws, which will further deepen the safety hazard.

After a long-term use of the piling hammer, there may be break at a connected end of a piston rod with the ram; after the piston rod is broken, a piston will rush into a valve block, causing mechanical collision to the hole and channel; in addition to this, a wear ring on the piston will fall off and enter an oil channel of the valve block, leading to jamming and other faults of valve members and bringing great inconvenience to a subsequent overhaul.

In actual use, different specifications of piles need to match with corresponding pile sleeves of piling hammers, and the pile sleeves of piling hammers have high costs and are cumbersome to replace, affecting the construction efficiency. Accordingly, there is a lack of a piling hammer in the prior art that has high safety and can improve the construction efficiency.

SUMMARY

The technical problem to be solved by the present disclosure is to provide a large-scale hydraulic offshore piling hammer capability of reducing safety hazards, prolonging service life and improving construction efficiency to address the above-mentioned disadvantages of the prior art.

In order to achieve the object described above, the present disclosure provides the following technical solutions. A large-scale offshore hydraulic piling hammer, including a hammer housing and a ram in the hammer housing; at least one hydraulic assembly capable of driving the ram to move axially along the hammer housing and disposed between the hammer housing and the ram; a pile sleeve connected to a bottom of the hammer housing and including an upper pile sleeve and a lower pile sleeve; and an anvil disposed in the upper pile sleeve; the hydraulic assembly being capable of driving the ram to strike the anvil, wherein an increased-diameter ring is disposed at a bottom of the anvil in the upper pile sleeve, a first mounting groove for mounting the anvil is formed at a top of the increased-diameter ring, a first mounting cavity is formed between an inner cavity of the increased-diameter ring and the anvil, a second mounting cavity is formed between a bottom surface of the increased-diameter ring and an inner wall of the lower pile sleeve, and the second mounting cavity has a diameter greater than a diameter of the first mounting cavity.

According to the above technical solutions, with the increased-diameter ring, the anvil is mounted in the first mounting groove on the increased-diameter ring, construction on piles having a larger diameter may be carried out, the size of the anvil and increased-diameter ring may be determined as required, and the first mounting cavity and the second mounting cavity are in a stepped form, which may be fitted to different specifications of piles; when a pile is inserted into the first mounting cavity, the anvil can transfer the impact of the ram directly to the pile; when construction on a pile having a larger diameter is required, the pile is inserted into the second mounting cavity, the top of the pile abuts against the bottom of the increased-diameter ring, the impact of the ram is transferred to the anvil, and then is transferred to the increased-diameter ring from the anvil, thus realizing piling. As a result, there is no need to replace the pile sleeve or make adjustments, and matching with two different specifications of piles can be realized, thus improving adaptability and lowering costs.

A further configuration of the present disclosure is that the hydraulic assembly includes a first cylinder block and a valve block, a piston and piston rods respectively disposed at two axial ends of the piston are slidably disposed in the first cylinder block, the first cylinder block is provided with a hydraulic cavity in which the piston is capable of reciprocating linearly along an axis of the hydraulic cavity, an oil inlet channel in communication with the hydraulic cavity is disposed between the valve block and the first cylinder block, and a limiting boss enabling the piston to be always located in the hydraulic cavity is disposed on a top of the piston.

According to the above technical solutions, as compared with a hydraulic assembly in the existing piling hammer, in the present disclosure, the piston is provided with the limiting boss, the limiting boss enables the piston to be always located in the hydraulic cavity rather than to enter the inside of the valve block when a break occurs at a connected end of the piston rod with the ram, and accordingly, even if the wear ring disposed on the piston falls off, it will not fall into the oil channel of the valve block to cause jamming or other faults of valve members and to affect the subsequent overhaul, which also avoids mechanical collision of the piston to the hole and channel.

A further configuration of the present disclosure is that a first through hole is formed in a middle of the limiting boss, the limiting boss sleeves the piston rod, a diameter of the oil inlet channel is less than a height of the limiting boss, and a diameter of the limiting boss is less than a diameter of the piston.

According to the above technical solutions, the diameter of the oil inlet channel is less than the height of the limiting boss, so that the wear ring is prevented from entering the valve block and always located in the hydraulic cavity; moreover, as the diameter of the limiting boss is less than the diameter of the piston, the limiting boss will not block an oil liquid entering the hydraulic cavity.

A further configuration of the present disclosure is that a ram lifting eye is disposed at a bottom of the piston rod, a thread portion having a thread is disposed at one end of the piston rod, a piston rod nut is disposed between the piston rod and the ram lifting eye, the piston rod nut is connected to the ram lifting eye via a detachable connection structure, the thread portion of the piston rod is threadedly connected with the piston rod nut, and an end portion of the piston rod penetrates a center screw hole of the piston rod nut to abut against the ram lifting eye, a lock clearance is reserved between the piston rod nut and the ram lifting eye.

According to the above technical solutions, the piston rod is threadedly connected with the piston rod nut, the end portion of the piston rod penetrates the center screw hole to prop the nut from the ram lifting eye to produce the lock clearance, thus avoiding that the piston rod nut and the ram lifting eye make a contact with each other to produce a rotation condition; after the piston rod and the ram lifting eye abut against each other closely, the ram lifting eye and the piston rod nut then exert force in dual directions through the detachable connection structure (which may be bolts and nuts, bolts and holes, pin connections, and the like), thus increasing friction between the end portion of the piston rod and the ram lifting eye, avoiding turning or loosening of the piston rod, and improving safety in piling with equipment.

A further configuration of the present disclosure is that a second mounting base for mounting the ram lifting eye is disposed at one end of the ram adjacent to the ram lifting eye, the second mounting base and the ram lifting eye are both provided with connection holes, a ram lifting pin is disposed in the connection holes, one end of the ram lifting pin is provided with an inner thread portion and an outer thread portion that have different pitches, the inner thread portion and the outer thread portion penetrate the connection holes to be respectively connected to an inner nut and an outer nut so as to connect a ram lifting mounting base to the ram lifting eye, a lock clearance is reserved between the inner nut and the outer nut, and the inner nut and the outer nut are connected via a detachable connection structure.

According to the above technical solutions, the threads at the end of the ram lifting pin are fin threads having different pitches (the inner thread portion and the outer thread portion), which may avoid relative rotation between the inner and outer nuts; besides, the ram lifting mounting base and the ram lifting eye are locked and in detachable connection by the ram lifting pin through the inner and outer nuts, thus facilitating mounting and maintenance; moreover, the lock clearance between the inner and outer nuts prevents the inner and outer nuts from being in contact with each other to produce a rotation condition; the inner and outer nuts are connected through the detachable connection structure (which may be bolts and nuts, bolts and holes, pin connection and the like), which can not only bring convenience to mounting and maintenance, but also achieve a locking effect by linkage, thus improving safety in piling with equipment.

A further configuration of the present disclosure is that the hammer housing is provided with a shackle assembly, the shackle assembly includes a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

According to the above technical solutions, since the annular groove and the limiting screw are provided, the limiting screw disposed between the annular groove and the pin nut can prevent the pin nut from retracting and restrain the position of the pin nut on the shackle pin, so that the pin nut will be less prone to moving in any working condition, ensuring the steadiness and safety in connection of the shackle; furthermore, the double washer is provided to further improve the steadiness in connection between the limiting screw and the first mounting hole, avoiding loosening of the limiting screw, and thus achieving stopping of the pin nut.

A further configuration of the present disclosure is that a second mounting hole is formed in an end portion of the shackle pin adjacent to the limiting screw, a safety pin is disposed in the second mounting hole, a third mounting hole transversally runs through a bottom of the safety pin, a clip pin is disposed in the third mounting hole, the clip pin includes a closed ring, a limiting rod and an elastic rod, one end of the limiting rod is connected to the closed ring, and an other end of the limiting rod is provided with a hook; and one end of the elastic rod is connected to the closed ring and an other end of the elastic rod is capable of being fastened with the limiting rod via the hook, and the elastic rod is capable of passing through the third mounting hole.

According to the above technical solutions, the second mounting hole provided facilitates the mounting of the safety pin; besides, the bottom of the safety pin is provided with the third mounting hole and the clip pin, which further avoids a situation in which the safety pin falls off, during assembling, the elastic rod passes through the third mounting hole and then is pressed downward to cross over the hook, and after the elastic rod is located in the hook, the elastic rod is fastened with the limiting rod, thus further improving safety.

A further configuration of the present disclosure is that the shackle body includes a bow, the bow has two ends parallel to each other, shackle arms are disposed at the two ends, the shackle arms are provided with shackle eyes, the bow is provided with a U-shaped groove, and the U-shaped groove is in a form of a semicircle; and a first mounting base is disposed on a top of the hammer housing, a fourth mounting hole corresponding to the shackle eyes is formed in the first mounting base, and the shackle pin is capable of passing through the fourth mounting hole and the shackle eyes to hinge the first mounting base to the first mounting base.

According to the above technical solutions, during assembling, the shackle eyes are aligned with the fourth mounting hole in the first mounting base, the shackle pin then passes through the shackle eyes and the fourth mounting hole, and first and second lock members are assembled with the shackle pin and the pin nut, such a structure is simple and easy to be assembled by an operator; the design of the U-shaped groove can enhance the overall strength of the connection part when the shackle is used for hoisting, helping to disperse the stress to avoid stress concentration at a certain point of the shackle, thus improving the durability and safety of the shackle; moreover, the shackle pin can pass through the fourth mounting hole and the shackle eyes to hinge the shackle body to the first mounting base, thus realizing a rotatable connection between the shackle and the hammer housing, and facilitating the mounting and demounting between the shackle and the hammer housing. With the mounting base, the stability is enhanced, and the mounting base serving as a support point can effectively disperse the force received by the shackle during use to reduce the impact on the hammer housing, thereby prolonging the service life, further improving the safety and avoiding the risk of the shackle accidentally falling off.

A further configuration of the present disclosure is that multiple shackle cushions capable of abutting against the bow are disposed on the top of the hammer housing, a positioning block corresponding to each of the shackle cushions is disposed on the top of the hammer housing, multiple first screw holes are formed in the positioning block, and multiple second screw holes respectively corresponding to the first screw holes are formed in each of the shackle cushions.

According to the above technical solutions, the arrangement of the positioning blocks facilitates the mounting and positioning of the shackle cushions; through the positioning blocks, the mounting positions of the shackle cushions can be determined quickly, and the detachable connection between the shackle cushions and the positioning blocks can be realized by standard parts such as screws; moreover, it can also facilitate the replacement of the shackle cushions to solve the problem of "it is easy to cause deformation and wear of the shackle cushions during long-term use".

A further configuration of the present disclosure is that multiple first buffer mechanisms are circumferentially disposed, above the increased-diameter ring, on an outer wall of the upper pile sleeve, each of the first buffer mechanisms includes a piston assembly and a second cylinder block in linkage with the piston assembly, the second cylinder block is provided with a cavity in which the piston assembly is capable of reciprocating linearly along an axis of the cavity, and an end portion of the second cylinder block is sealedly connected to an inflation assembly in communication with the cavity; and a shock absorbing chamber integrated with the hammer housing is disposed at a joint between the hammer housing and the upper pile sleeve, an anti-shock ring with one end abutting against the anvil is disposed in the shock absorbing chamber, multiple buffering rings that abut against an inner wall of the shock absorbing chamber and the anti-shock ring are disposed at an other end of the anti-shock ring, and the ram is capable of passing through the buffering rings and the anti-shock ring to strike the anvil.

According to the above technical solutions, the first buffer mechanism is located between the upper pile sleeve and the increased-diameter ring and used for absorbing rebound energy of the increased-diameter ring when a pile having a larger diameter is loaded and subjected to piling; high-pressure nitrogen gas or other inert gas is filled to the cavity by means of the inflation assembly, and pressure of the nitrogen gas filled may be adjusted on the basis of the size of the piling hammer and the geological condition, to be adapted to various working conditions; moreover, during use, the ram is moved axially along the hammer housing, and then passes through the buffering rings and the anti-shock ring to strike the anvil, the anvil strikes the pile into the hard rock stratum, and an anti-shock force is transferred to the anti-shock ring through anvil, and then is transferred to the buffering rings by the anti-shock ring, so that the peak value of the anti-shock force is reduced; besides, the buffering rings stacked in multiple layers will absorb and buffer the anti-shock force and then act onto the entire shock absorbing chamber; as the hammer housing and the shock absorbing chamber are integrated, the anti-shock force that decreases in steps is fed back to the hammer housing through the shock absorbing chamber; the anti-shock force is buffered frequently during the whole process, avoiding excessive shock on inner components of the hammer housing, thus prolonging the service life of the equipment; for shock absorbing chambers in different sizes, the buffering rings in the same specification may be stacked and packed in batch into the shock absorbing chambers, without manufacturing buffering rings in other specifications, thus greatly improving the adaptability of the buffering rings and lowering equipment costs.

The present disclosure will be further described in detail below with reference to the accompanying drawings and embodiments.

Figure 1:
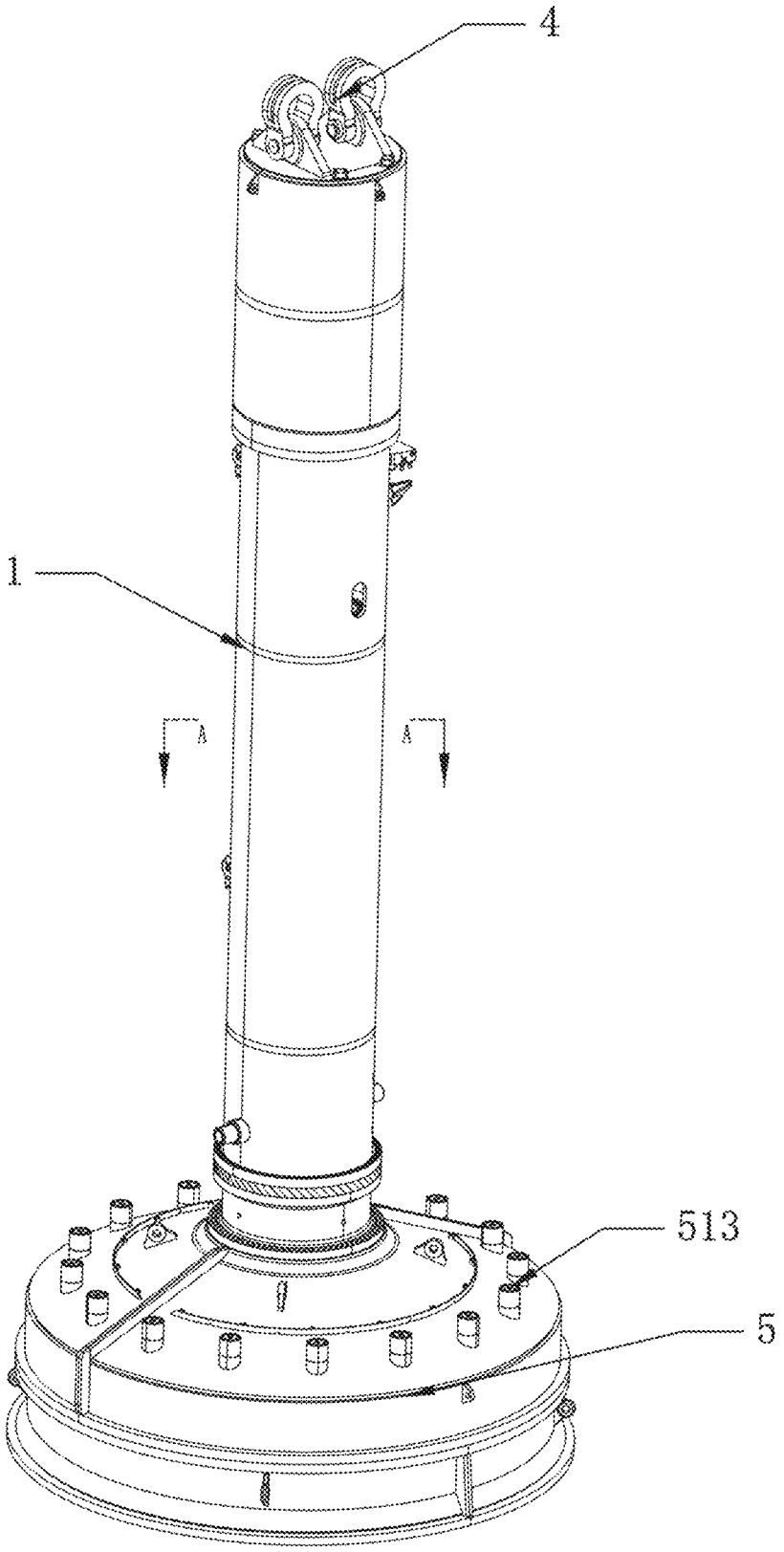
FIG. 1 is a schematic diagram of an overall structure of the present disclosure.

Reference signs: hammer housing 1, shackle cushion 11, second screw hole 111, first mounting base 12, fourth mounting hole 121, positioning block 13, first screw hole 131, ram rail 14, impact chamber 15, air channel 16, shock absorbing chamber 17, anti-shock ring 171, buffering ring 172, ram 2, second mounting base 21, connection hole 211, ram lifting pin 212, inner thread portion 212*a*, outer thread portion 212*b*, inner nut 213, outer nut 214, hydraulic assembly 3, first cylinder block 31, hydraulic cavity 311, valve block 32, oil inlet channel 321, piston 33, limiting boss 331, piston rod 34, thread portion 341, piston rod nut 342, ram lifting eye 35, shackle assembly 4, shackle body 41, bow 411, shackle arm 412, shackle eye 413, U-shaped groove 414, shackle pin 42, annular groove 421, second mounting hole 422, pin nut 43, first mounting hole 431, first limiting step 431*a*, limiting screw 44, double washer 441, safety pin 45, third mounting hole 451, clip pin 452, closed ring 452*a*, limiting rod 452*b*, hook 4521*b*, elastic rod 452*c*, pile sleeve 5, upper pile sleeve 51, increased-diameter ring 511, first mounting groove 511*a*, first mounting cavity 511*b*, second mounting cavity 511*c*, anvil 512, first buffer mechanism 513, piston assembly 513*a*, second cylinder block 513*b*, cavity 5131*b*, inflation assembly 5132*b*, and lower pile sleeve 52.

DETAILED DESCRIPTION OF THE EMBODIMENTS

The specific embodiment is merely an explanation of the present disclosure and is not a limitation on the present disclosure. A person skilled in the art may make modifications to the embodiment without creative contribution as necessary after reading this specification, and these modifications are protected by the patent law as long as they are within the scope of the claims of the present disclosure.

Figure 5:
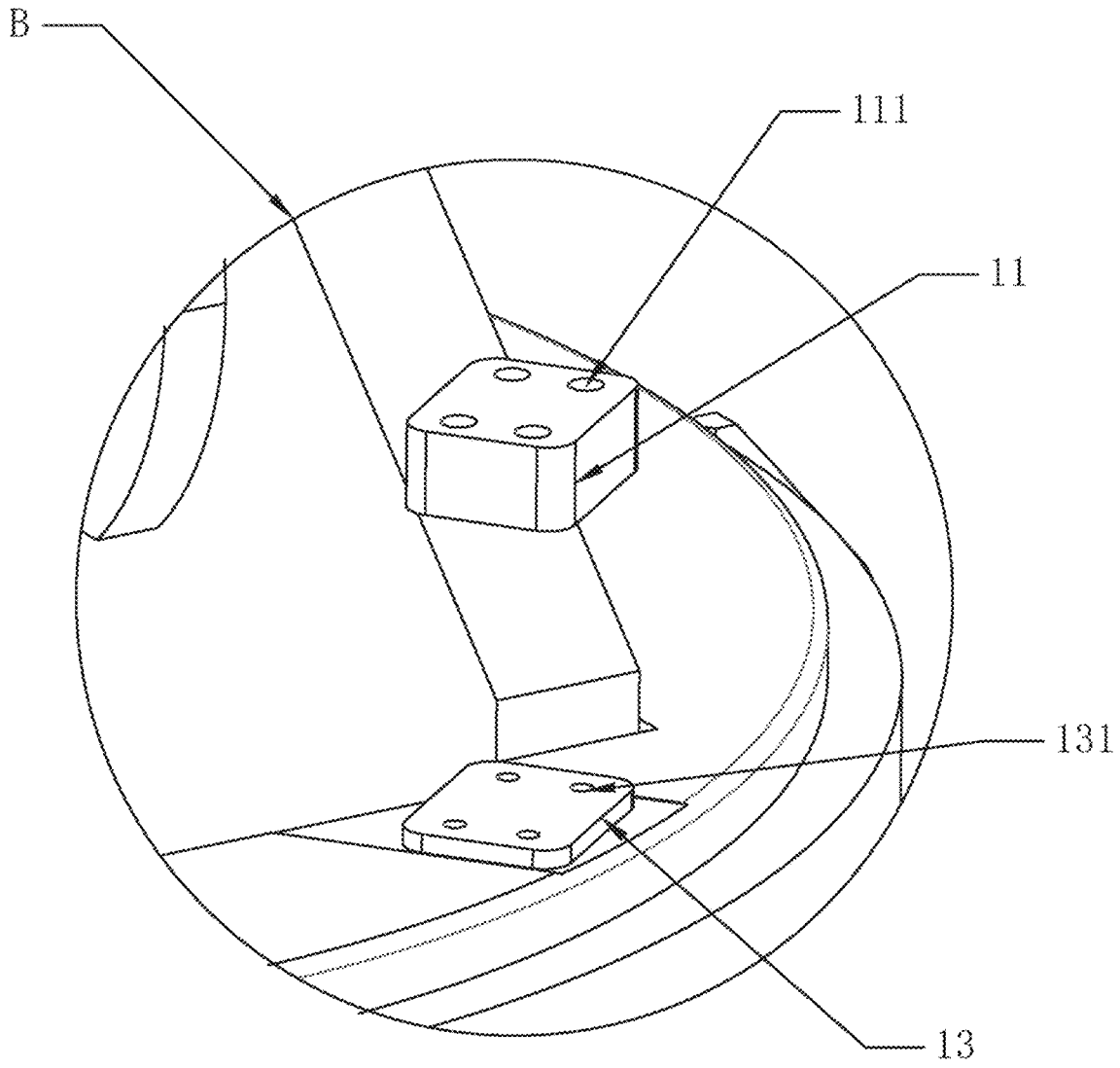
FIG. 5 is an enlarged view of part B in FIG. 2 of the present disclosure.
Figure 6:
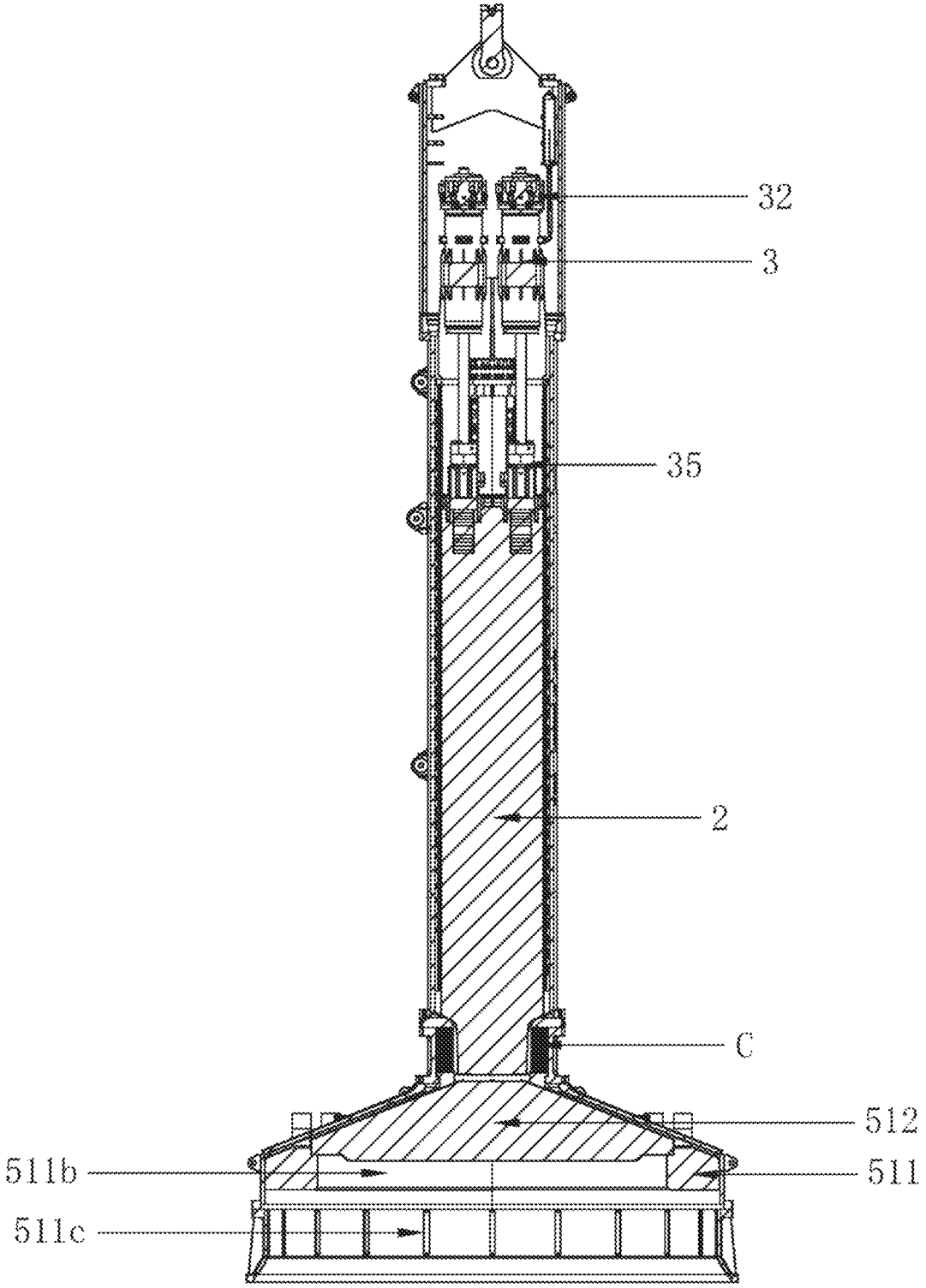
FIG. 6 is an overall cross-sectional view of the present disclosure.

A large-scale offshore hydraulic piling hammer as shown in FIGS. 1 to 14 includes a hammer housing 1 and a ram 2 in the hammer housing 1. At least one hydraulic assembly 3 capable of driving the ram 2 to move axially along the hammer housing 1 is disposed between the hammer housing 1 and the ram 2. Preferably, two hydraulic assemblies 3 are used in the present disclosure, which can improve the driving effect to the ram 2. As shown in FIGS. 6 and 10, a pile sleeve 5 is connected to the bottom of the hammer housing 1, the pile sleeve 5 includes an upper pile sleeve 51 and a lower pile sleeve 52. An anvil 512 is disposed in the upper pile sleeve 51, and the hydraulic assembly 3 is capable of driving the ram 2 to strike the anvil 512. An increased-diameter ring 511 is disposed at the bottom of the anvil 512 in the upper pile sleeve 51. A first mounting groove 511*a* for mounting the anvil 512 is formed at the top of the increased-diameter ring 511. A first mounting cavity 511*b* is formed between an inner cavity of the increased-diameter ring 511 and the anvil 512. A second mounting cavity 511*c* is formed between a bottom surface of the increased-diameter ring 511 and an inner wall of the lower pile sleeve 52. The second mounting cavity 511*c* has a diameter greater than a diameter of the first mounting cavity 511*b*.

Figure 7:
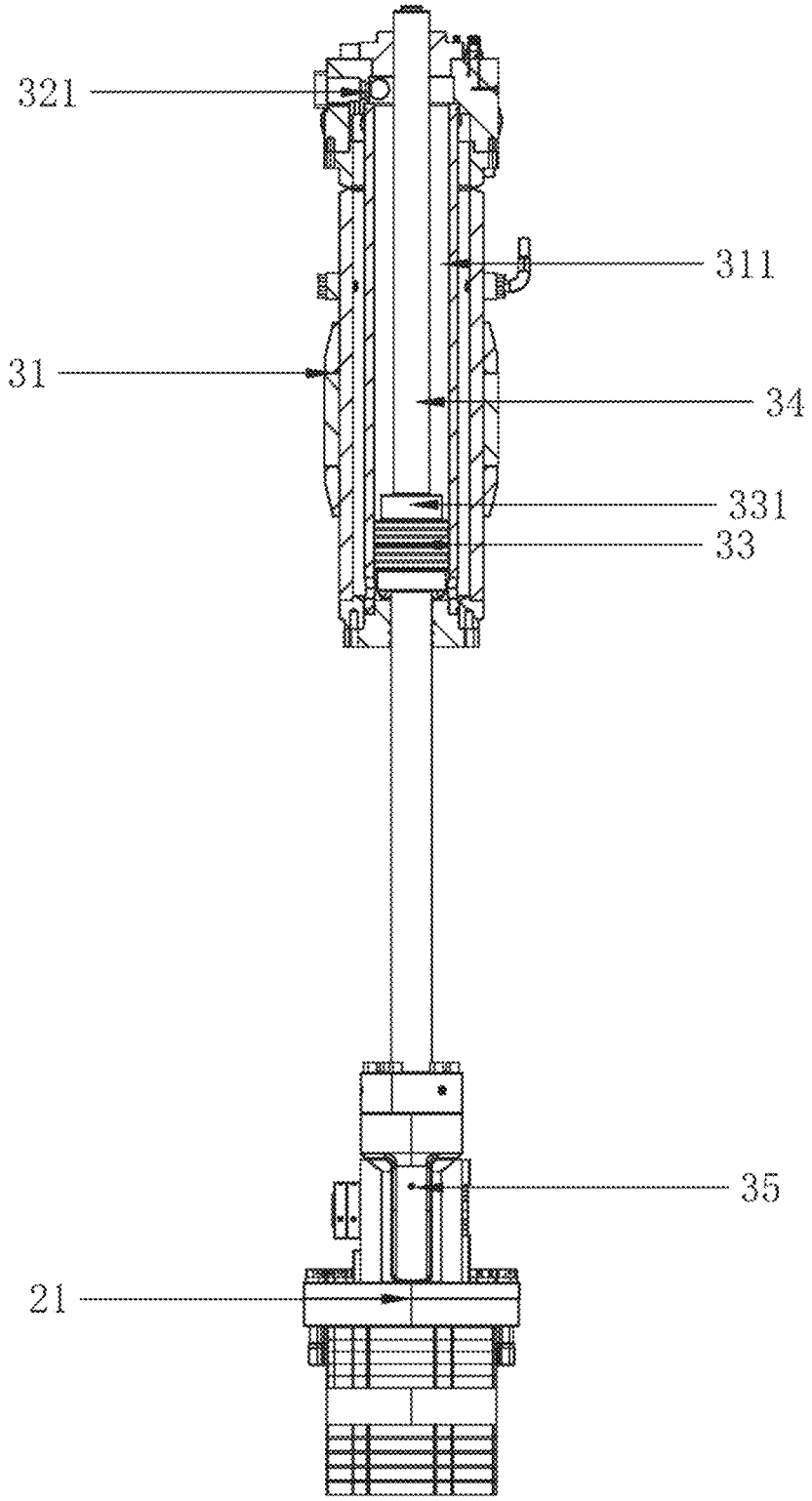
FIG. 7 is a cross-sectional view of a hydraulic assembly of the present disclosure.
Figure 9:
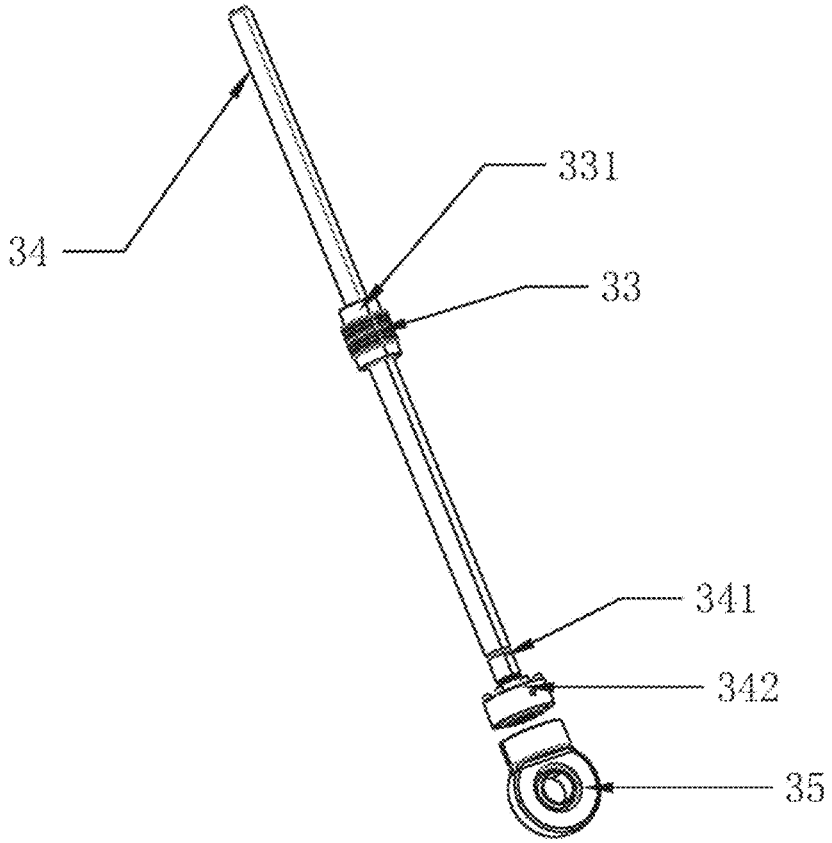
FIG. 9 is an exploded view of a piston rod of the present disclosure.
Figure 10:
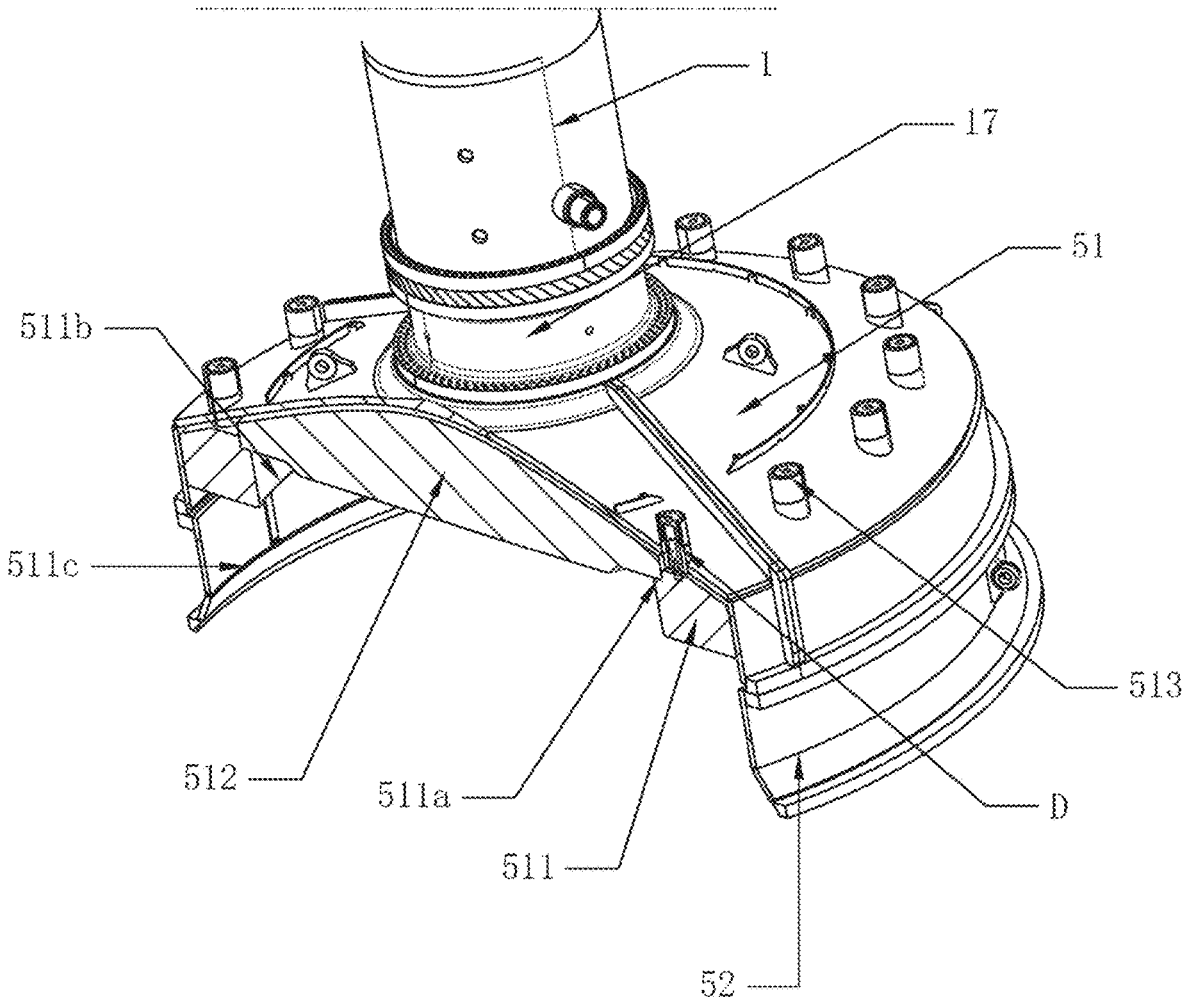
FIG. 10 is a cross-sectional view of a pile sleeve of the present disclosure.

The hydraulic assembly 3 as shown in FIGS. 6, 7 and 9 includes a first cylinder block 31 and a valve block 32, a piston 33 and a piston rod 34 respectively disposed at two axial ends of the piston 33 are slidably disposed in the first cylinder block 31, and the first cylinder block 31 is provided with a hydraulic cavity 311 in which the piston 33 is capable of reciprocating linearly along the axis of the hydraulic cavity; an oil inlet channel 321 in communication with the hydraulic cavity 311 is provided between the valve block 32 and the first cylinder block 31, and a limiting boss 331 enabling the piston 33 to be always located in the hydraulic cavity 311 is disposed on the top of the piston 33; the limiting boss 331 is provided with a first through hole in a middle of the limiting boss, through which the limiting boss sleeves the piston rod 34, a diameter of the oil inlet channel 321 is less than a height of the limiting boss 331, and a diameter of the limiting boss 331 is less than a diameter of the piston 33.

As shown in FIG. 9, the bottom of the piston rod 34 is provided with a ram lifting eye 35, one end of the piston rod 34 is provided with a thread portion 341 having a thread, a piston rod nut 342 is disposed between the piston rod 34 and the ram lifting eye 35, the piston rod nut 342 is connected to the ram lifting eye 35 via a detachable connection structure, the thread portion 341 of the piston rod 34 is in threaded connection with the piston rod nut 342, and an end portion of the piston rod 34 penetrates a center screw hole of the piston rod nut 342 to abut against the ram lifting eye 35, a lock clearance is reserved between the piston rod nut 342 and the ram lifting eye 35.

Figure 8:
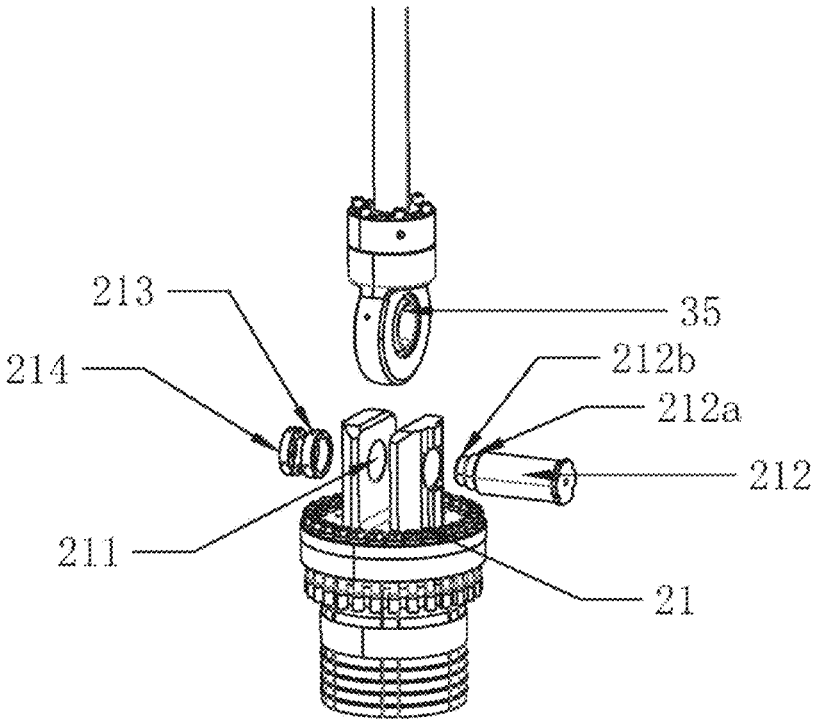
FIG. 8 is an exploded view of a ram lifting eye and a second mounting base of the present disclosure.

As shown in FIG. 8, a second mounting base 21 for mounting the ram lifting eye 35 is disposed at one end of the ram 2 adjacent to the ram lifting eye 35, the second mounting base 21 and the ram lifting eye 35 are both provided with connection holes 211, a ram lifting pin 212 is disposed in the connection holes 211, one end of the ram lifting pin 212 is provided with an inner thread portion 212*a* and an outer thread portion 212*b* that have different pitches, the inner thread portion and the outer thread portion 212*b* penetrate the connection holes 211 to be connected to an inner nut and an outer nut 214 so as to connect a ram lifting mounting base to the ram lifting eye 35, a lock clearance is reserved between the inner nut and the outer nut 214, and the inner nut and the outer nut 214 are connected via a detachable connection structure.

As shown in FIGS. 1 to 5, the hammer housing 1 is provided with a shackle assembly 4, the shackle assembly 4 includes a shackle body 41, a shackle pin 42 passing across two ends of the shackle body 41, and a pin nut 43 at one end of the shackle pin 42; one end of the shackle pin 42 is provided with an annular groove 421, the pin nut 43 sleeves over the shackle pin 42 and has a first mounting hole 431 at a position corresponding to the annular groove 421, the first mounting hole 431 runs through an outer wall of the pin nut 43 to an inner wall thereof, a limiting screw 44 is disposed in the first mounting hole 431, the bottom of the limiting screw 44 is located in the annular groove 421, a first limiting step 431*a* is provided in the first mounting hole 431, and a double washer 441 is disposed between the first limiting step 431*a* and the limiting screw 44.

Figure 3:
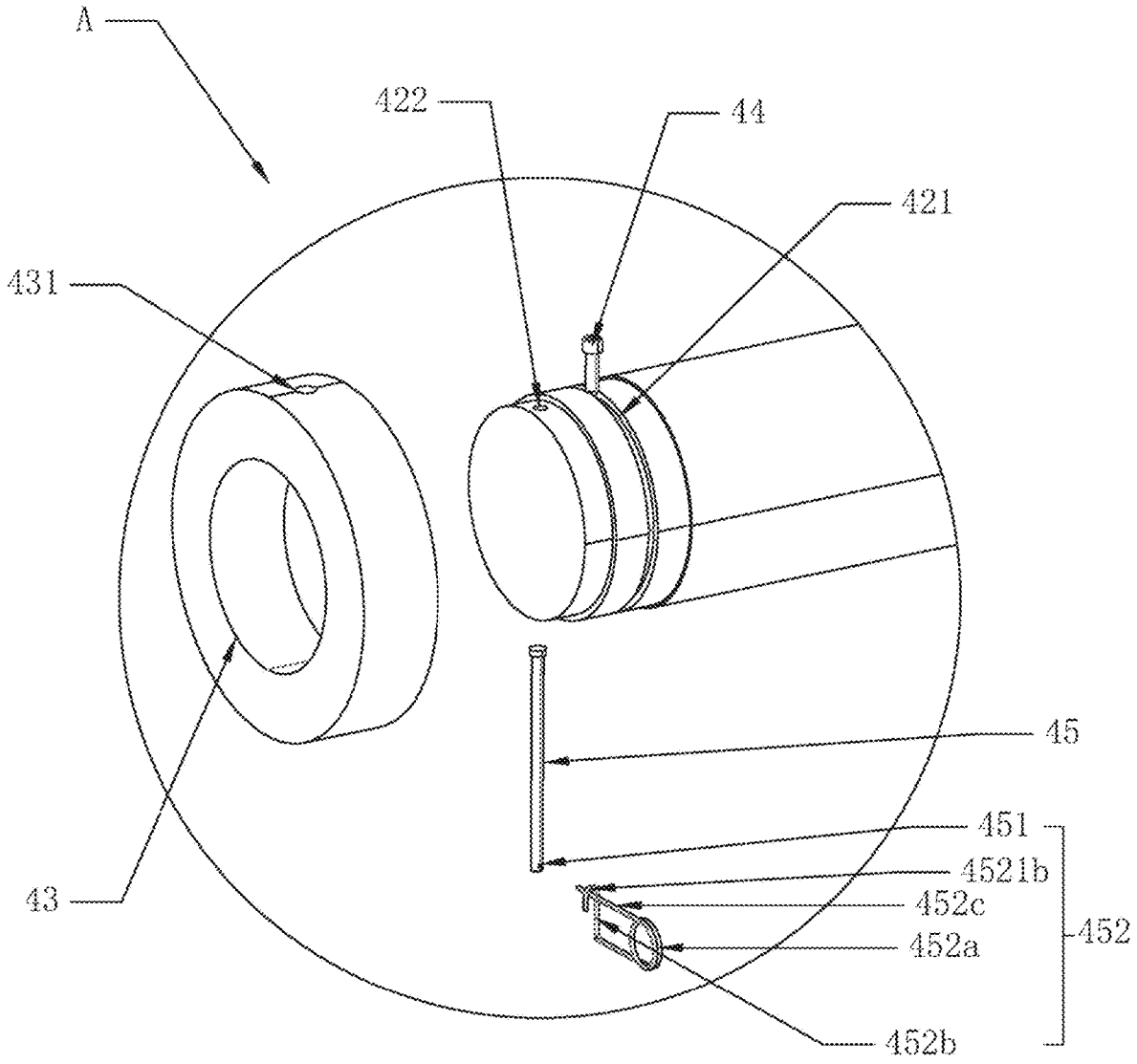
FIG. 3 is an enlarged view of part Ain FIG. 2 of the present disclosure.
Figure 4:
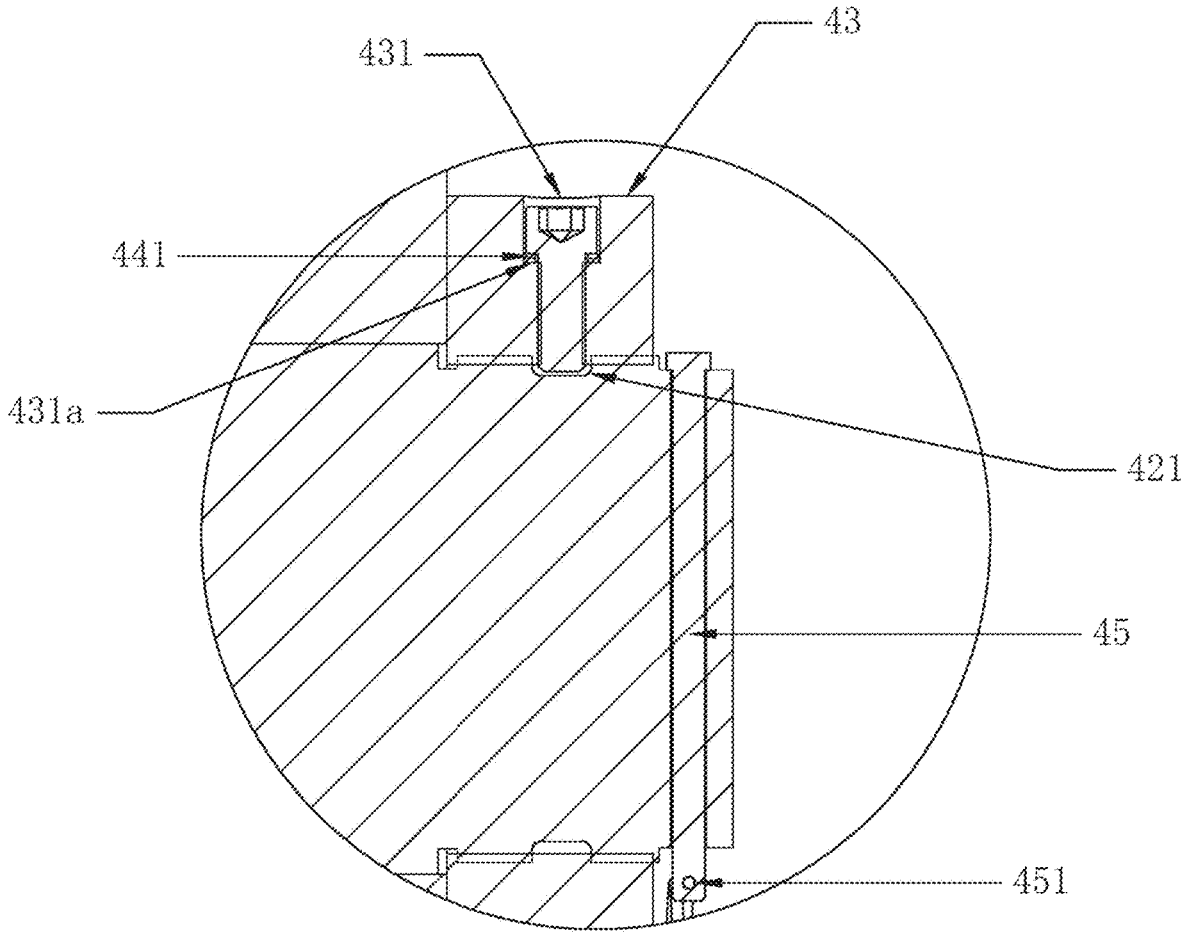
FIG. 4 is a partial cross-sectional view of the shackle of the present disclosure.

As shown in FIGS. 3 and 4, an end portion of the shackle pin 42 adjacent to the limiting screw 44 is provided with a second mounting hole 422, a safety pin 45 is disposed in the second mounting hole 422, a third mounting hole 451 transversally runs through the bottom of the safety pin 45, a clip pin 452 is disposed in the third mounting hole 451, the clip pin 452 includes a closed ring 452*a*, a limiting rod 452*b* and an elastic rod 452*c*, one end of the limiting rod 452*b* is connected to the closed ring 452*a*, and the other end of the limiting rod is provided with a hook 4521*b*; one end of the elastic rod 452*c* is connected to the closed ring 452*a* and the other end of the elastic rod is capable of being fastened with the limiting rod 452*b* via the hook 4521*b*, and the elastic rod 452*c* is capable of passing through the third mounting hole 451.

Figure 2:
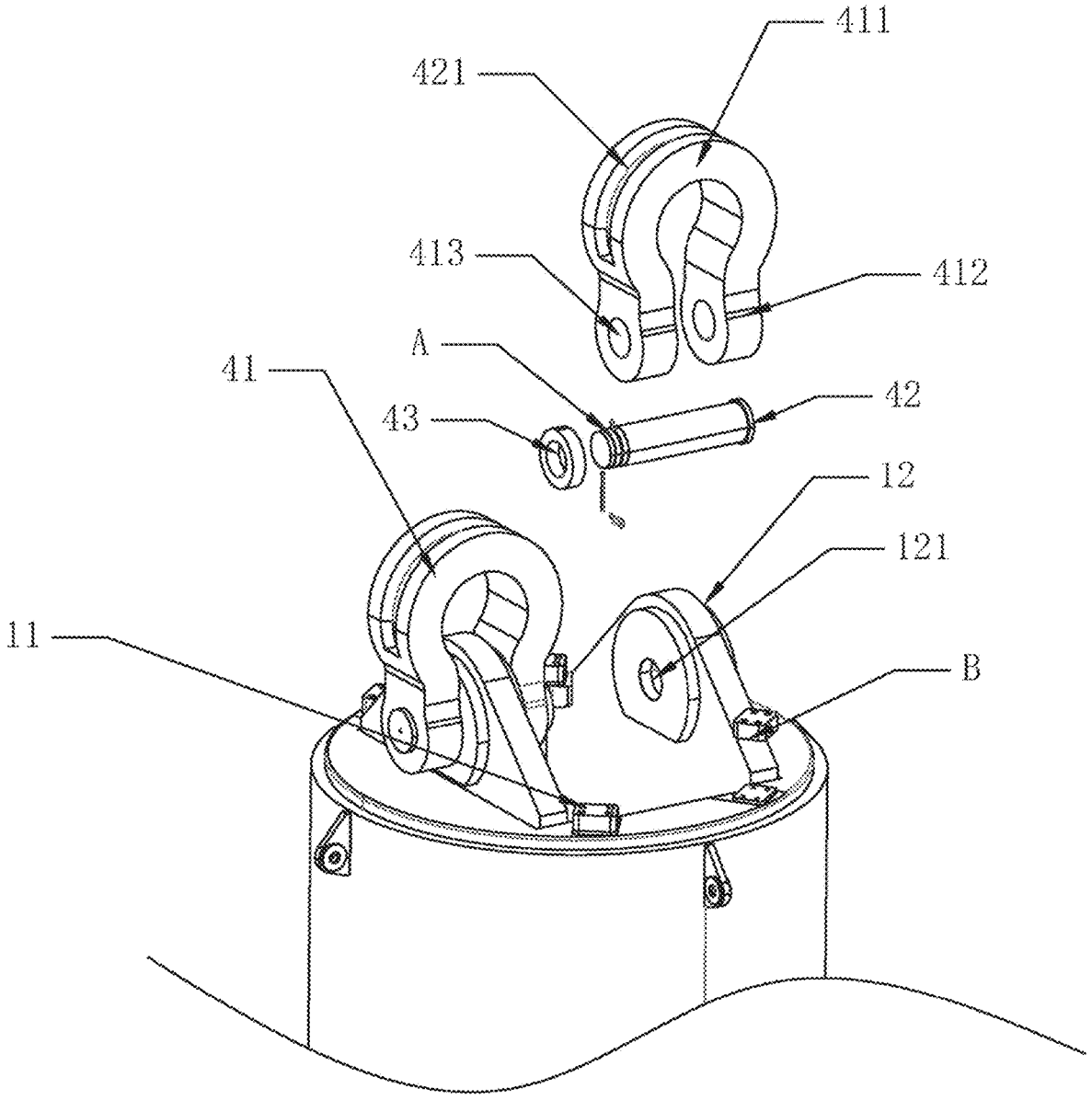
FIG. 2 is an exploded view of a shackle of the present disclosure.

As shown in FIG. 2, the shackle body 41 includes a bow 411, the bow 411 has two ends parallel to each other, shackle arms 412 are disposed at the two ends, the shackle arms 412 are provided with shackle eyes 413 respectively, the bow 411 is provided with a U-shaped groove 414, and the U-shaped groove 414 is in the form of a semicircle; a first mounting base 12 is disposed on the top of the hammer housing 1, the first mounting base 12 is provided with a fourth mounting hole 121 corresponding to the shackle eyes 413, and the shackle pin 42 is capable of passing through the fourth mounting hole 121 and the shackle eyes 413 to hinge the shackle body 41 to the first mounting base 12. As shown in FIGS. 2 and 5, multiple shackle cushions 11 capable of abutting against the bow 411 are disposed on the top of the hammer housing 1, a positioning block 13 corresponding to each shackle cushion 11 is disposed on the top of the hammer housing 1, the positioning block 13 is provided with multiple first screw holes 131, and multiple second screw holes 111 respectively corresponding to the first screw holes 131 are formed in each of the shackle cushions 11.

Figure 11:
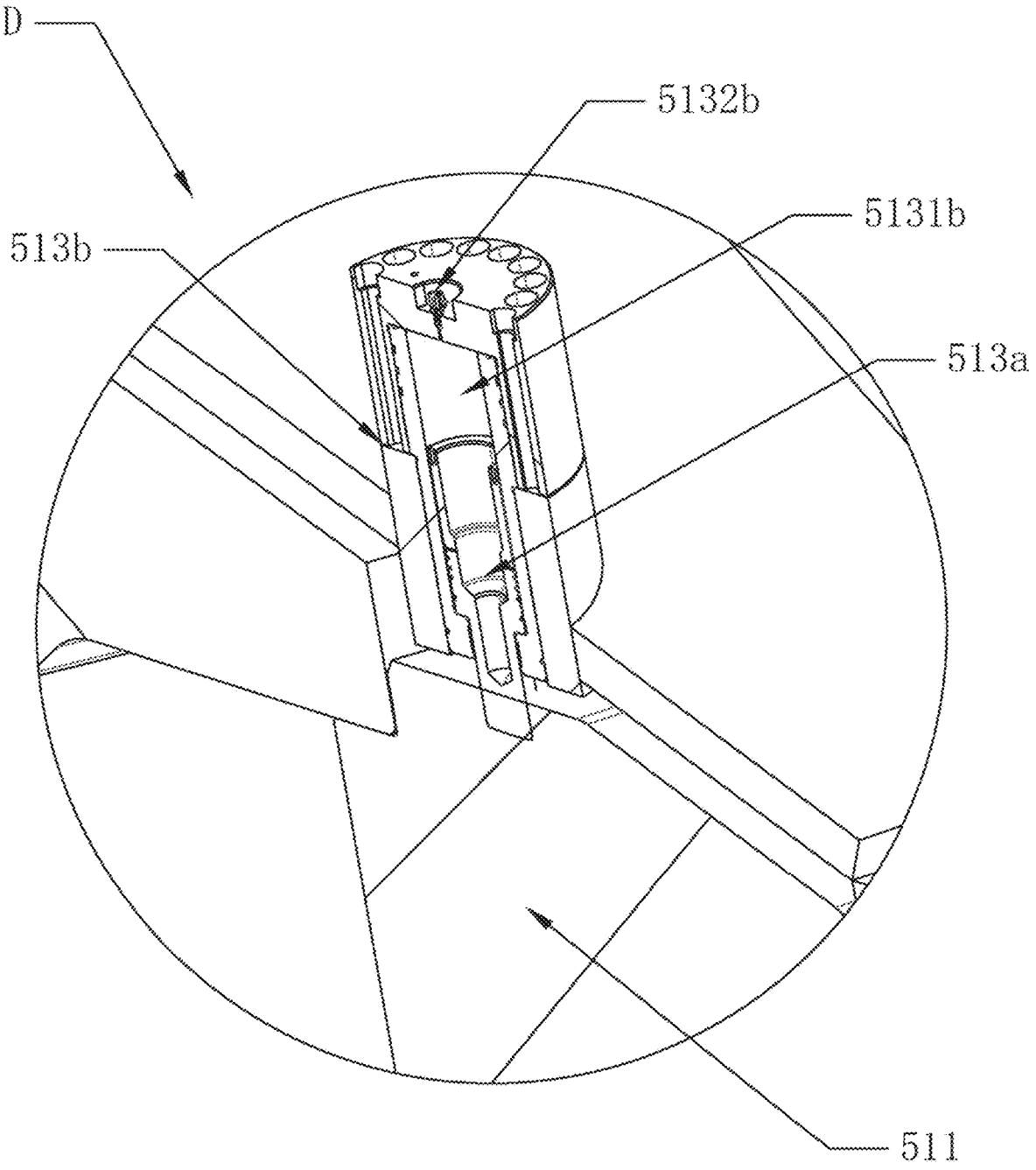
FIG. 11 is an enlarged view of part D in FIG. 10 of the present disclosure.
Figure 12:
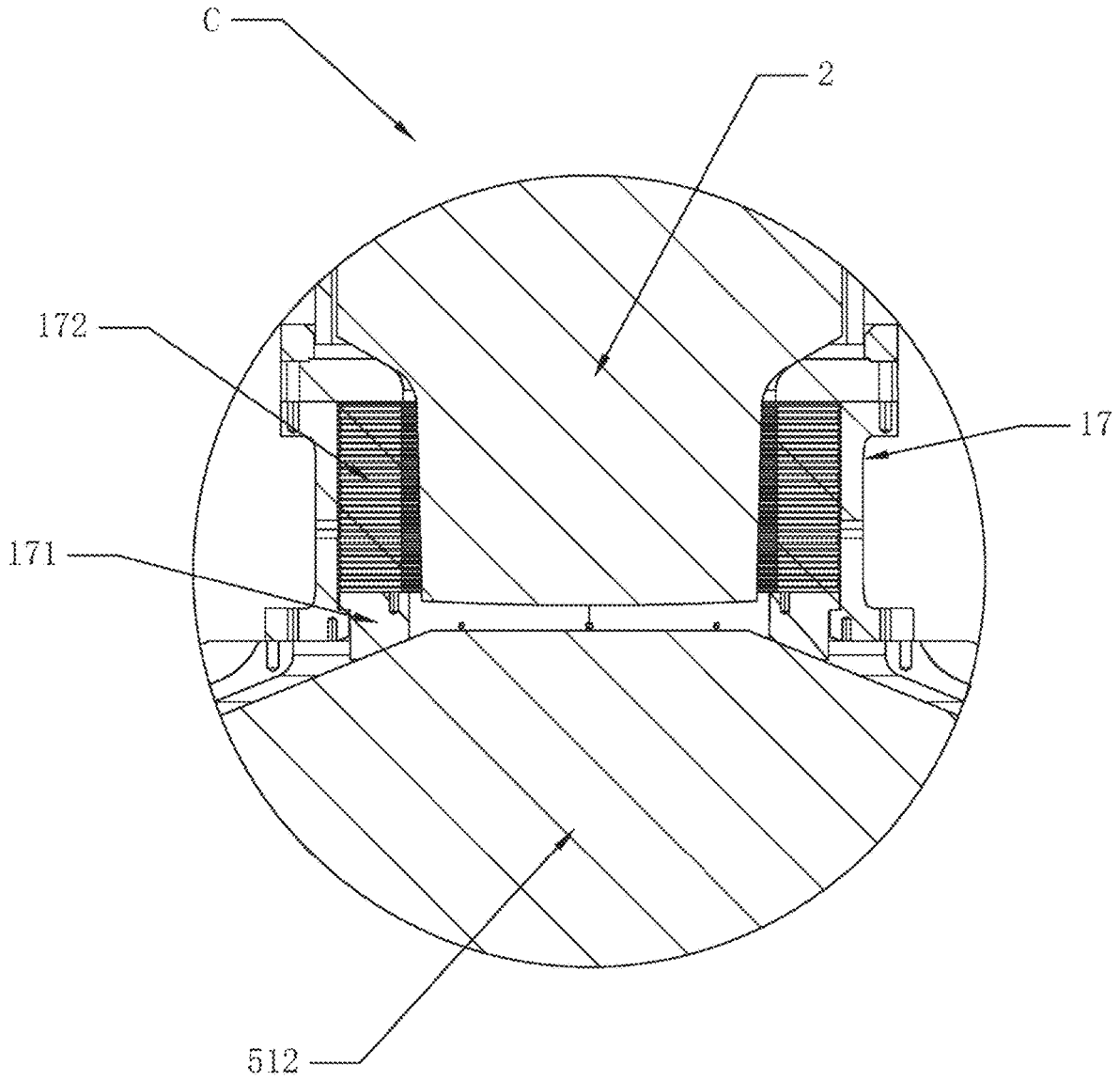
FIG. 12 is an enlarged view of part C in FIG. 6 of the present disclosure.

As shown in FIGS. 10 to 12, multiple first buffer mechanisms 513 are circumferentially disposed, above the increased-diameter ring 511, on an outer wall of the upper pile sleeve 51, each first buffer mechanism 513 includes a piston assembly 513*a* and a second cylinder block 513*b* in linkage with the piston assembly 513*a*, the second cylinder block 513*b* is provided with a cavity 5131*b* in which the piston assembly 513*a* is capable of reciprocating linearly along the axis of the cavity, and an end portion of the second cylinder block 513*b* is sealedly connected to an inflation assembly 5132*b* that is in communication with the cavity 5131*b*; a shock absorbing chamber 511 integrated with the hammer housing 1 is provided at the joint between the hammer housing 1 and the upper pile sleeve 51, an anti-shock ring 171 with one end abutting against the anvil 512 is disposed in the shock absorbing chamber 17, multiple buffering rings 172 that abut against an inner wall of the shock absorbing chamber 17 and the anti-shock ring 171 are disposed at the other end of the anti-shock ring, and the ram 2 is capable of passing through the buffering rings 172 and the anti-shock ring 171 to strike the anvil 512.

Figure 13:
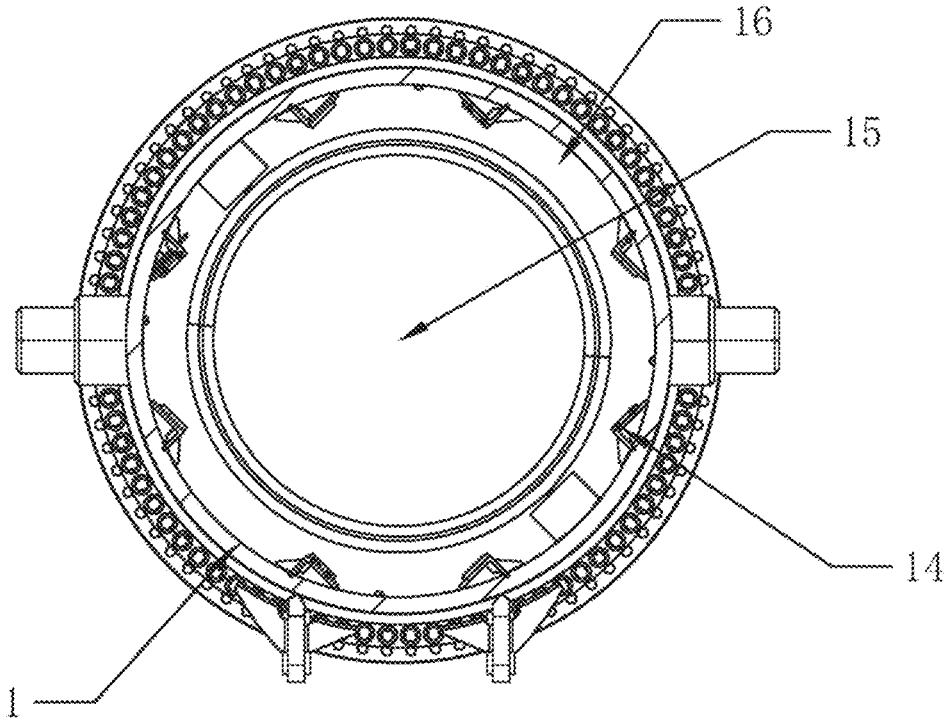
FIG. 13 is a cross-sectional view taken along line A-A in FIG. 1 of the present disclosure.
Figure 14:
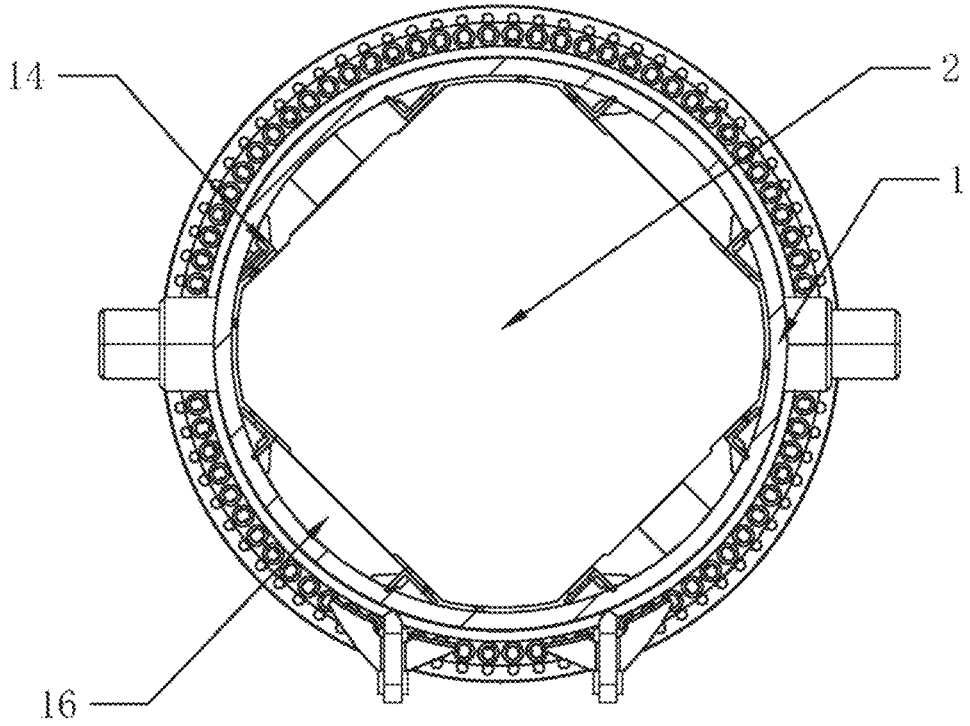
FIG. 14 is a cross-sectional view after a ram is mounted in FIG. 13 of the present disclosure.

In addition, a hammer carrier is disposed inside the hammer housing 1 as shown in FIGS. 13 and 14. The hammer carrier includes at least two ram rails 14, and an impact chamber 15 for the ram 2 to move axially along the ram rails 14 is formed between the ram rails 14. The cross-section of the body of the hammer housing 1 is circular, and the body of the hammer housing 1 cooperates with the impact chamber 15 to form multiple air channels 16. Preferably, the number of the ram rails 14 is 8, and the number of the air channels 16 is 4. By replacing the original square hammer housing 1 with the circular hammer housing 1, the problem that welds of the square hammer housing 1 are prone to tearing is solved by utilizing the rigidity and strength inherent in the circular structure, and the circular hammer housing has the advantages of small wear, minimum resistance, and good appearance. Besides, in underwater piling, the circular structure can seal the surface of the housing better than the square structure, so that the housing maintains a high airtightness underwater. The original square ram 2 is adopted in the circular hammer housing 1, and the ram 2 moves up and down along the hammer carrier, so that portions of the hammer housing 1 that are not attached by the ram 2 form the air channels 16, where through guide surfaces that are provided on both sides of each corner of the ram 2, the ram 2 can be positioned and guided by 8 ram rails 14, improving the stability of piling. The ram 2 is disposed in the circular hammer housing 1, and 4 air channels 16 will be formed in the hammer housing 1, so that when the impact hammer drives piles underwater, the air pressure brought out during lifting of the ram 2 will be quickly discharged through the air channels 16 on the external airtight condition underwater, thus improving the impact force of the impact hammer during underwater piling.

As compared with the circumstance that there are many safety hazards in the prior art, during use of the large-scale offshore hydraulic piling hammer of the present disclosure, the limiting screw 44 and the annular groove 421 can prevent the pin nut from retracting 43, thus further improving the stability in connection between the pin nut 43 and the shackle pin 42; besides, the arrangement of the safety pin 45 and the clip pin 452 plays a role in double insurance, ensuring the steadiness and safety in connection of the shackle; in addition, the shackle cushions 11 are provided, and the shackle cushions 11 distributed on two sides in the rotation direction of the shackle can replace the shackle to collide with the hammer housing 1, thus protecting the hammer housing 1 and the shackle, avoiding mechanical collision between the shackle and the hammer housing 1, prolonging service lives of the shackle and the hammer housing 1, and improving safety in use. Moreover, as compared with a hydraulic assembly 3 in the existing piling hammer, in the present disclosure, the piston 33 is provided with the limiting boss 331, the limiting boss 331 enables the piston 33 to be always located in the hydraulic cavity 311 rather than to enter the inside of the valve block 32 when a break occurs at the connected end of the piston rod 34 with the ram 2, and accordingly, even if the wear ring disposed on the piston 33 falls off, it will not fall into the oil channel of the valve block 32 to cause jamming or other faults of valve members and to affect the subsequent overhaul, which also avoids mechanical collision of the piston 33 to the hole and channel. Finally, construction on a pile having a larger diameter can be carried out by providing the increased-diameter ring 511 in the upper pile sleeve 51. When the corresponding pile is inserted into the first mounting cavity 511*b*, the anvil 512 can transfer the impact of the ram 2 directly to the pile. When construction on a pile having a larger diameter is required, the corresponding large-diameter pile is inserted into the second mounting cavity 511*c*, the top of the pile abuts against the bottom of the increased-diameter ring 511, the impact of the ram 2 is transferred to the anvil 512, and then is transferred to the increased-diameter ring 511 from the anvil 512, thus realizing piling. In this process, there is no need to replace the pile sleeve 5 or make adjustments, and matching with two different specifications of piles can be realized, thus improving adaptability and lowering costs.

What is claimed is:

1. A large-scale offshore hydraulic piling hammer, comprising a hammer housing and a ram in the hammer housing; at least one hydraulic assembly capable of driving the ram to move axially along the hammer housing and disposed between the hammer housing and the ram; a pile sleeve connected to a bottom of the hammer housing and comprising an upper pile sleeve and a lower pile sleeve; and an anvil disposed in the upper pile sleeve; the hydraulic assembly being capable of driving the ram to strike the anvil, wherein an increased-diameter ring is disposed at a bottom of the anvil in the upper pile sleeve, a first mounting groove for mounting the anvil is formed at a top of the increased-diameter ring, a first mounting cavity is formed between an inner cavity of the increased-diameter ring and the anvil, a second mounting cavity is formed between a bottom surface of the increased-diameter ring and an inner wall of the lower pile sleeve, and the second mounting cavity has a diameter greater than a diameter of the first mounting cavity.

2. The large-scale offshore hydraulic piling hammer according to claim 1, wherein the hydraulic assembly comprises a first cylinder block and a valve block, a piston and one piston rod of two piston rods are slidably disposed in the first cylinder block, the two piston rods are respectively disposed at two axial ends of the piston, the first cylinder block is provided with a hydraulic cavity in which the piston is capable of reciprocating linearly along an axis of the hydraulic cavity, an oil inlet channel in communication with the hydraulic cavity is disposed between the valve block and the first cylinder block, and a limiting boss enabling the piston to be always located in the hydraulic cavity is disposed on a top of the piston.

3. The large-scale offshore hydraulic piling hammer according to claim 2, wherein a first through hole is formed in a middle of the limiting boss, the limiting boss sleeves the one piston rod, a diameter of the oil inlet channel is less than a height of the limiting boss, and a diameter of the limiting boss is less than a diameter of the piston.

4. The large-scale offshore hydraulic piling hammer according to claim 3, wherein a ram lifting eye is disposed at a bottom of the piston rod, a thread portion having a thread is disposed at one end of the piston rod, a piston rod nut is disposed between the piston rod and the ram lifting eye, the piston rod nut is detachably connected to the ram lifting eye, the thread portion of the piston rod is threadedly connected with the piston rod nut, and an end portion of the piston rod penetrates a center screw hole of the piston rod nut to abut against the ram lifting eye, a lock clearance is reserved between the piston rod nut and the ram lifting eye.

5. The large-scale offshore hydraulic piling hammer according to claim 4, wherein a second mounting base for mounting the ram lifting eye is disposed at one end of the ram adjacent to the ram lifting eye, the second mounting base and the ram lifting eye are both provided with connection holes, a ram lifting pin is disposed in the connection holes, one end of the ram lifting pin is provided with an inner thread portion and an outer thread portion that have different pitches, the inner thread portion and the outer thread portion penetrate the connection holes to be respectively connected to an inner nut and an outer nut so as to connect the second mounting base to the ram lifting eye, a lock clearance is reserved between the inner nut and the outer nut, and the inner nut and the outer nut are detachably connected with each other.

6. The large-scale offshore hydraulic piling hammer according to claim 5, wherein the hammer housing is provided with a shackle assembly, the shackle assembly comprises a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

7. The large-scale offshore hydraulic piling hammer according to claim 5, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

8. The large-scale offshore hydraulic piling hammer according to claim 4, wherein the hammer housing is provided with a shackle assembly, the shackle assembly comprises a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

9. The large-scale offshore hydraulic piling hammer according to claim 4, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

10. The large-scale offshore hydraulic piling hammer according to claim 3, wherein the hammer housing is provided with a shackle assembly, the shackle assembly comprises a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

11. The large-scale offshore hydraulic piling hammer according to claim 3, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

12. The large-scale offshore hydraulic piling hammer according to claim 2, wherein the hammer housing is provided with a shackle assembly, the shackle assembly comprises a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

13. The large-scale offshore hydraulic piling hammer according to claim 2, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

14. The large-scale offshore hydraulic piling hammer according to claim 1, wherein the hammer housing is provided with a shackle assembly, the shackle assembly comprises a shackle body, a shackle pin passing across two ends of the shackle body, and a pin nut at one end of the shackle pin, an annular groove is formed on one end of the shackle pin, the pin nut sleeves the shackle pin and has a first mounting hole at a position corresponding to the annular groove, the first mounting hole runs through an outer wall of the pin nut to an inner wall of the pin nut, a limiting screw is disposed in the first mounting hole, a bottom of the limiting screw is located in the annular groove, a first limiting step is disposed in the first mounting hole, and a double washer is disposed between the first limiting step and the limiting screw.

15. The large-scale offshore hydraulic piling hammer according to claim 14, wherein a second mounting hole is formed in an end portion of the shackle pin adjacent to the limiting screw, a safety pin is disposed in the second mounting hole, a third mounting hole transversally runs through a bottom of the safety pin, a clip pin is disposed in the third mounting hole, the clip pin comprises a closed ring, a limiting rod and an elastic rod, one end of the limiting rod is connected to the closed ring, and an other end of the limiting rod is provided with a hook; and one end of the elastic rod is connected to the closed ring and an other end of the elastic rod is capable of being fastened with the limiting rod via the hook, and the elastic rod is capable of passing through the third mounting hole.

16. The large-scale offshore hydraulic piling hammer according to claim 15, wherein the shackle body comprises a bow, the bow has two ends parallel to each other, shackle arms are disposed at the two ends, the shackle arms are provided with shackle eyes, the bow is provided with a U-shaped groove, and the U-shaped groove is in a form of a semicircle; and a first mounting base is disposed on a top of the hammer housing, a fourth mounting hole corresponding to the shackle eyes is formed in the first mounting base, and the shackle pin is capable of passing through the fourth mounting hole and the shackle eyes to hinge the shackle body to the first mounting base.

17. The large-scale offshore hydraulic piling hammer according to claim 16, wherein a plurality of shackle cushions capable of abutting against the bow are disposed on the top of the hammer housing, a plurality of positioning blocks corresponding to respective shackle cushions are disposed on the top of the hammer housing, a plurality of first screw holes are formed in each positioning block of the plurality of positioning blocks, and a plurality of second screw holes respectively corresponding to the first screw holes are formed in each of the shackle cushions.

18. The large-scale offshore hydraulic piling hammer according to claim 17, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

19. The large-scale offshore hydraulic piling hammer according to claim 1, wherein a plurality of first buffer mechanisms are circumferentially disposed, above the increased-diameter ring, on an outer wall of the upper pile sleeve, each of the first buffer mechanisms comprises a piston assembly and a second cylinder block in linkage with the piston assembly, the second cylinder block is provided with a cavity in which the piston assembly is capable of reciprocating linearly along an axis of the cavity; and a shock absorbing chamber integrated with the hammer housing is disposed at a joint between the hammer housing and the upper pile sleeve, an anti-shock ring with one end abutting against the anvil is disposed in the shock absorbing chamber, a plurality of buffering rings that abut against an inner wall of the shock absorbing chamber and the anti-shock ring are disposed at an other end of the anti-shock ring, and the ram is capable of passing through the buffering rings and the anti-shock ring to strike the anvil.

* * * * *